US006741020B2

(12) United States Patent
Wakita et al.

(10) Patent No.: US 6,741,020 B2
(45) **Date of Patent: *May 25, 2004**

(54) CATHODE RAY, TUBE INCLUDING AN ELECTRON GUN HAVING SPECIFIC RELATION OF AXIAL LENGTH OF FOCUS ELECTRODE AND FOCUS ELECTRODE-SCREEN DISTANCE

(75) Inventors: Shoichi Wakita, Chiba (JP); Yasuo Tanaka, Ichihara (JP); Toshio Nakayama, Chousei (JP); Nobuyuki Suzuki, Isumi (JP); Shoji Shirai, Mobara (JP)

(73) Assignees: Hitachi, Ltd., Tokyo (JP); Hitachi Electronic Devices Co., Ltd., Mobara (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/338,853

(22) Filed: Jan. 9, 2003

(65) Prior Publication Data

US 2003/0090192 A1 May 15, 2003

Related U.S. Application Data

(63) Continuation of application No. 09/769,281, filed on Jan. 26, 2001, now Pat. No. 6,507,143.

(51) Int. Cl.[7] ..... H01J 29/46

(52) U.S. Cl. ..... 313/414; 313/448; 313/449

(58) Field of Search ..... 313/414, 448, 313/449, 412, 413, 440, 409, 415; 315/382.1, 382

(56) References Cited

U.S. PATENT DOCUMENTS

| | | | |
|---|---|---|---|
| 4,271,374 | A | 6/1981 | Kimura |
| 4,965,489 | A | 10/1990 | Shirai et al. |
| 5,077,498 | A | 12/1991 | Odenthal |
| 6,031,326 | A | 2/2000 | Suzuki et al. |
| 6,225,765 | B1 | 5/2001 | Yatsu et al. |
| 6,304,026 | B1 | 10/2001 | Nakamura et al. |
| 6,339,300 | B2 | 1/2002 | Yatsu et al. |

FOREIGN PATENT DOCUMENTS

| | | |
|---|---|---|
| JP | 58-31696 | 7/1983 |
| JP | 2000277033 | 10/2000 |

*Primary Examiner*—Nimeshkumar D. Patel
*Assistant Examiner*—Karabi Guharay
(74) *Attorney, Agent, or Firm*—Antonelli, Terry, Stout & Kraus, LLP

(57) ABSTRACT

A cathode ray tube has an anode and a focus electrode. The large-diameter cylinder portion of the focus electrode is disposed concentrically within a large-diameter cylinder portion of the anode. The anode and a first electrode facing a cathode side end of the focus electrode are electrically connected together within the cathode ray tube. The following relationship is satisfied: $-LP+184.9 \geqq LG4 \geqq 0.0004\,LP^3-0.1571\,LP^2+21.006\,LP-922.41$, where LG4 (mm) is an axial length of the focus electrode, and LP (mm) is a distance from a phosphor screen side end of the focus electrode to a center of a phosphor screen.

9 Claims, 5 Drawing Sheets

FIG. 2

BEAM SPOT DIAMETERS OBTAINED BY SIMULATION (mm)

| LENS-SCREEN DISTANCE LP (mm) | | 142.4 | | | 137.4 | | | 132.4 | | |
|---|---|---|---|---|---|---|---|---|---|---|
| CATHODE CURRENT (mA) | | 0.5 | 2.0 | 6.0 | 0.5 | 2.0 | 6.0 | 0.5 | 2.0 | 6.0 |
| FOCUS ELECTRODE LENGTH LG4 (mm) | 48.7 | 0.168 | 0.158 | 0.298 | 0.161 | 0.153 | 0.287 | 0.157 | 0.148 | 0.292 |
| | 38.7 | 0.192 | 0.174 | 0.311 | 0.187 | 0.169 | 0.300 | 0.182 | 0.163 | 0.277 |
| | 28.7 | 0.223 | 0.198 | 0.317 | 0.214 | 0.189 | 0.295 | 0.204 | 0.175 | 0.279 |

CATHODE RAY, TUBE INCLUDING AN ELECTRON GUN HAVING SPECIFIC RELATION OF AXIAL LENGTH OF FOCUS ELECTRODE AND FOCUS ELECTRODE-SCREEN DISTANCE

CROSS REFERENCE TO RELATED APPLICATION

This is a continuation of U.S. application Ser. No. 09/769,281, filed Jan. 26, 2001, now U.S. Pat. No. 6,507,143, the subject matter of which is incorporated by reference herein.

BACKGROUND OF THE INVENTION

The present invention relates to a cathode ray tube, and in particular to a cathode ray tube capable of shortening its overall length without degrading its focus characteristics by optimizing its electron gun in a single-electron-gun cathode ray tube such as a cathode ray tube used for a projection TV.

Generally, a projection TV receiver uses three cathode ray tubes exclusively for reproduction of red, green and blue primary color images, respectively, magnifies and projects three primary color images (a 5.5-inch diagonal phosphor screen, for example) provided by the three cathode ray tubes on a viewing screen (a 40-inch viewing screen, for example) by using optical lenses or mirror such that the three primary color images are superposed on the viewing screen to produce a color image.

Among electron guns used for the cathode ray tube for the projection TV is one disclosed in Japanese Patent Publication No. Sho 58-31696. This electron gun will be explained by reference to FIG. 5. In FIG. 5, a control grid electrode 102 having a cathode 101 insulatingly secured thereto, an auxiliary focus electrode 103, an accelerating electrode 104, a first anode 110 and a second anode 111 are insulatingly supported on common insulating rods 112, and are housed within a bulb neck portion 107.

The second anode 111 is provided with a small-diameter support end portion 113 at its first anode 110 side end, and supported on the insulating rods 112 adjacent thereto. A tongue-shaped conductive piece 114 attached to a front end portion of the second anode 111 is supplied with a high voltage via a conductive film 115 coated on an inner surface of the bulb neck portion 107, and supplies the high voltage to the second anode 111. The first anode 110 is provided with a neck portion 116 which passes through the small-diameter support end portion 113 of the second anode 111 without contacting the small-diameter support end portion 113, and a large-diameter front end portion 117 which is positioned within a large-diameter cylinder portion of the second anode 111 and has an outside diameter larger than an inside diameter of the small-diameter support end portion 113. The large-diameter front end portion 117 and the large-diameter cylinder portion of the second anode 111 form a main lens therebetween.

With the above structure of the electrodes, both roundness of the second anode 111 and concentricity between the first anode 110 and the second anode 111 can be improved, and further the inside diameter of the second anode 111 can be made close to that of the bulb neck portion 107. Consequently, the large-diameter main lens with spherical aberration reduced can be obtained without increasing the diameter of the bulb neck portion and the diameters of the beam spots can be minimized.

In FIG. 5, reference numeral 118 denotes a faceplate, and reference numeral 119 denotes a phosphor screen formed on an inner surface of the faceplate 118.

Generally, the projection TV receiver requiring three cathode ray tubes and an optical projection system have a disadvantage of greater outside dimensions, and therefore there has been a great demand for reduction of the size of cathode ray tube, especially for the shorter overall length of the cathode ray tubes without deterioration in their focus characteristics.

However, consideration has never been given to shortening of the overall length of the cathode ray tubes in the electron gun for a cathode ray tube described in the Japanese Patent Publication No. Sho 58-31696.

There has been a problem in that generally deterioration in focusing characteristics has been inevitable if the axial length of an electron gun is shortened for shortening of the overall length of the cathode ray tube.

SUMMARY OF THE INVENTION

It is an object of the present invention to provide a cathode ray tube capable of shortening the overall length of a cathode ray tube without deteriorating its focusing characteristics by optimizing its electron gun.

A color cathode ray tube in accordance with the present invention achieves the above-mentioned object by a representative structure.

In accordance with an embodiment of the present invention, there is provided a cathode ray tube comprising: a vacuum envelope comprising a panel portion, a neck portion, a funnel portion having a large-diameter end thereof connected to the panel portion and a small-diameter end thereof connected to the neck portion, and a stem having conductive pins embedded therein and closing off an open end of the neck portion on a side thereof opposite from the funnel portion; a phosphor screen formed on an inner surface of the panel portion; an electron gun housed within the neck portion; and a deflection yoke mounted externally of the vacuum envelope in a vicinity of a transition region between the neck portion and the funnel portion; characterized in that the electron gun comprises a cathode, a beam control electrode, an accelerating electrode, a first electrode, a focus electrode and an anode arranged in the order named with specified spacings therebetween, the anode is formed of a large-diameter cylinder portion disposed on a phosphor screen side thereof and a small-diameter cylinder portion disposed on a cathode side thereof, the large-diameter cylinder portion and the small-diameter cylinder portion being connected together in a direction of an axis of the cathode ray tube, the focus electrode is formed of a large-diameter cylinder portion disposed on a phosphor screen side thereof and having a diameter larger than a diameter of the small-diameter cylinder portion of the anode, and a small-diameter cylinder portion disposed on a side cathode thereof and having a diameter smaller than a diameter of the small-diameter cylinder portion of the anode, the large-diameter cylinder portion and the small-diameter cylinder portion of the focus electrode being connected together in the direction of the axis of the cathode ray tube, the large-diameter cylinder portion of the focus electrode being disposed concentrically with and within the large-diameter cylinder portion of the anode, the anode and the first electrode are electrically connected together within the cathode ray tube, and the following inequalities are satisfied: $-LP+184.9 \geqq LG4 \geqq 0.0004\ LP^3-0.1571\ LP^2+21.006\ LP-922.41$, $LP \geqq 131.7$, where LG4 (mm) is an axial length of the focus electrode, and LP (mm) is a distance from a phosphor screen side end of the focus electrode to a center of the phosphor screen.

BRIEF DESCRIPTION OF THE DRAWINGS

In the accompanying drawings, in which like reference numerals designate similar components throughout the figures, and in which:

FIG. 2 is a table showing 5% beam spot diameters obtained by computer simulation with a distance LP from a phosphor screen side end of a focus electrode (G4) to a center of the phosphor screen, and a length LG4 of the focus electrode as parameters;

DETAILED DESCRIPTION OF THE PREFERRED EMBODIMENTS

Figure 1:
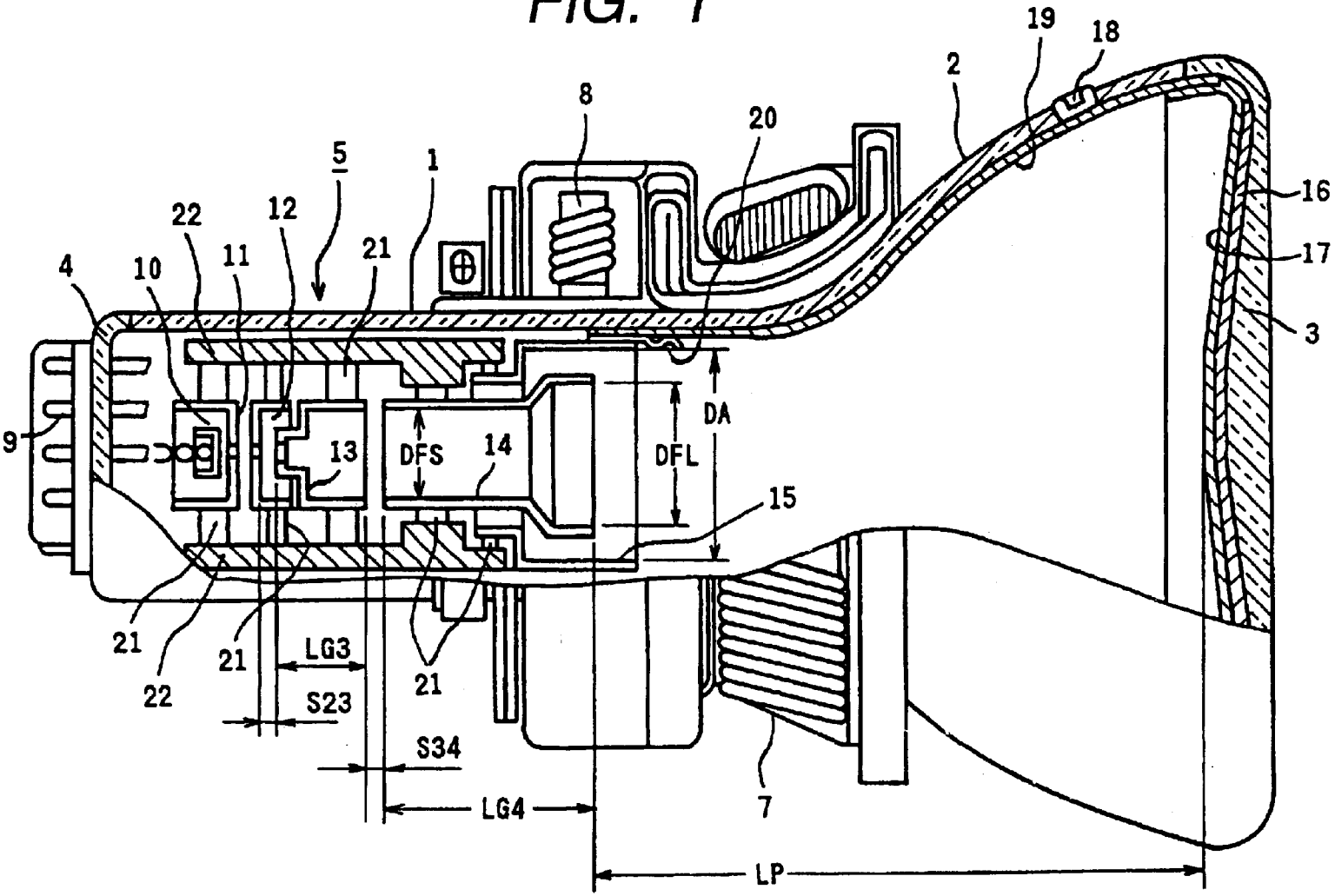
FIG. 1 is a partially broken-away side view of a cathode ray tube in accordance with an embodiment of the present invention.

Embodiments in accordance with the present invention will now be explained in detail by referring to examples showing in the drawings.

The present inventors have studied realization of shortening of the overall length of a cathode ray tube used for the projection TV by using a cathode ray tube employing an electron gun 5 whose structure is schematically shown in FIG. 1.

FIG. 1 is a partially broken-away side view of a cathode ray tube in accordance with an embodiment of the present invention. A funnel portion 2 is connected to one end of a neck portion 1, a panel portion 3 is connected to a large-diameter open end of the funnel portion 2, and a stem 4 is connected to the other end of the neck portion 1 such that a vacuum envelope is formed.

A single beam type electron gun 5 is housed within the neck portion 1 having an outside diameter of 29.1 mm. The electron gun 5 is comprised of an indirectly heated cathode 10, a beam control electrode (G1) 11, an accelerating electrode (G2) 12, a third electrode (G3) 13, a focus electrode (G4) 14 and an anode (G5) 15 arranged with specified spacings therebetween and fixed by embedding electrode supports 21 attached to sidewalls of the respective electrodes 11–15 in a pair of bead glasses 22.

Each of the electrodes is supplied with a specified voltage via a stem pin 9 embedded in the stem 4. In a typical operating condition, the cathode 10 is supplied with about 190 V on the average, the control electrode (G1) 11 is grounded, the accelerating electrode (G2) 12 is supplied with a voltage of 550–600 V, the third electrode (G3) 13 and the anode (G5) 15 are supplied with 30 kV which is the highest voltage, and the focus electrode (G4) 14 is supplied with a focus voltage (for example, about 7.7 kV).

The panel portion 3 is configured such that its thickness is great at its screen center and small at its peripheral portion and consequently, the panel portion functions as a lens. A phosphor screen 16 of about 5.5-in (about 139.7 mm) diagonal dimension is formed on an inner surface of the panel portion 3. An evaporated Al film 17 is formed on a surface of the phosphor screen 16 on its electron gun side.

An anode button 18 for supplying an anode voltage is embedded in the funnel portion 2, and the anode voltage applied to the anode button 18 is applied to the third electrode (G3) 13 and the anode (G5) 15 via the inner graphite film 19 coated on an inner surface of the funnel portion 2 and a bulb spacer contact 20 fixed to the anode (G5) 15. The anode voltage is applied to the evaporated Al film 17 also.

An electron beam (not shown) emitted from the electron gun 5 is deflected by a deflection yoke 7 to thereby scan the phosphor screen 16. In this embodiment, a diagonal deflection angle is 90 degrees, and a speed modulation coil 8 is employed for improving display contrast.

For the purpose of shortening the overall length of the cathode ray tube, the present inventors made the following experiments by computer simulation to find an optimum value of the axial length LG4 of the focus electrode (G4) 14 without deteriorating focus characteristics when the axial length of the electron gun 5.

The conditions for the simulation are as follows:

- a beam aperture diameter in the beam control electrode (G1) 11=0.6 mm,
- a thickness of a portion in which the beam aperture of the beam control electrode (G1) 11 is made =0.08 mm,
- a beam aperture diameter in the accelerating electrode (G2) 12=0.6 mm,
- a thickness of a portion in which the beam aperture of the accelerating electrode (G2) 12 is made =0.39 mm,
- a beam aperture diameter on a cathode 10 side end of the third electrode (G3) 13=2.2 mm,
- a diameter of an opening in an anode (G5) 15 side end of the third electrode (G3) 13=9.9 mm,
- an axial length LG3 of the third electrode (G3) 13=20.5 mm,
- a diameter DFS of an opening in a cathode 10 side end of the focus electrode (G4) 14=9.9 mm,
- a diameter DFL of an opening in an anode (G5) 15 side end of the focus electrode (G4) 14=15.8 mm,
- a diameter DA of an opening in a phosphor screen 16 side end of the anode (G5) 15=21.95 mm,
- a spacing between the cathode 10 and the beam control electrode (G1) 11=0.11 mm,
- a spacing between the beam control electrode (G1) 11 and the accelerating electrode (G2) 12=0.27 mm,
- a spacing S23 between the accelerating electrode (G2) 12 and the third electrode (G3) 13=1.73 mm,
- a spacing S34 between the third electrode (G3) 13 and the focus electrode (G4) 14=2.0 mm,
- a potential of the cathode 10=adjusted for a current for each of the simulation conditions,
- a potential of the beam control electrode (G1) 11=grounded,
- a potential of the accelerating electrode (G2) 12=600 V,
- a potential of the third electrode (G3) 13=30 kV,
- a potential of the focus electrode (G4) 14=adjusted for optimum focus for each of the simulation conditions, and
- a potential of the anode (G5) 15=30 kV.

Two parameters, a lens-screen distance LP and a focus electrode length LG4, are chosen for the simulations, where (1) the lens-screen distance LP is defined as a distance from a phosphor screen 16 side end of the focus electrode (G4) 14 to a center of the phosphor screen 16, and (2) the focus electrode length LG4 is defined as an axial length of the focus electrode (G4) 14.

Various combinations of the two parameters have been evaluated based upon 5% beam spot diameters at cathode currents of 0.5 mA, 2.0 mA and 6.0 mA, where the 5% beam spot diameter is defined as a distance between two points in which the beam intensity is 5% of the peak value in a beam intensity distribution on the phosphor screen.

The above cathode current values are the evaluation condition chosen in consideration of cathode ray tubes serving various purposes covering a small-current region used in display monitors and a large-current region in TV receivers.

Figure 3:
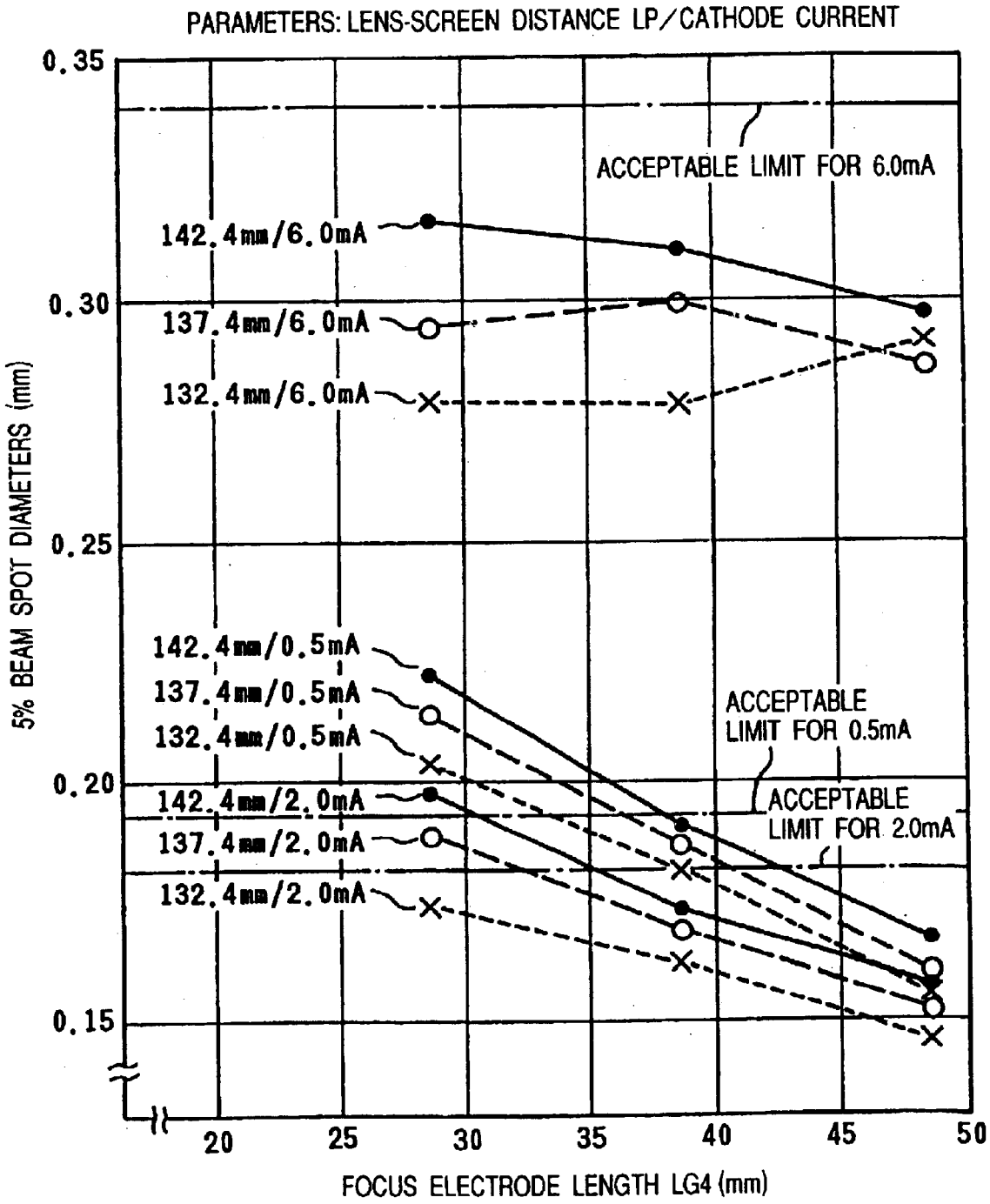
FIG. 3 is a graph showing plots of 5% beam spot diameters obtained by computer simulation with a distance LP from a cathode side end of a focus electrode (G4) to a center of the phosphor screen, and a length LG4 of the focus electrode as parameters.

FIG. 2 shows the results obtained by computer simulation performed by choosing three cases of 142.4 mm, 137.4 mm and 132.4 mm as the lens-screen distances LP, and choosing three cases of 48.7 mm, 38.7 mm and 28.7 mm as the focus electrode lengths LG4, and FIG. 3 shows the plots of the simulation results of FIG. 2.

Further, FIG. 3 shows the plots of the acceptable upper limits of the 5% beam spot diameters, 0.193 mm, 0.182 mm and 0.343 mm at the cathode currents of 0.5 mA, 2.0 mA and 6.0 mA, respectively, and the above acceptable upper limits are required of the cathode ray tubes for the projection TV by the projection TV receivers.

The above acceptable upper limits of the 5% beam spot diameters are such that small-sized projection TV receivers are capable of retaining focus characteristics equivalent to those of a large-diameter electron gun used in a projection TV cathode ray tube incorporated in a large-sized projection TV receiver intended for a viewing screen having a diagonal dimension of 50 inches.

The projection TV cathode ray tube incorporating the large-diameter electron gun and used in the above-mentioned large-sized projection TV receiver needs to be 270 mm in overall length, and therefore it is difficult to employ this large-diameter electron gun in a projection cathode ray tube for a compact projection TV receiver intended for a viewing screen having a diagonal dimension of a 40-inch (37–49 inches) class.

The present invention relates to a projection TV cathode ray tube capable of shortening its overall length and at the same time retaining focus characteristics equivalent to those of the above-mentioned projection TV cathode ray tubes used for large-sized projection TV receivers, and thereby the projection TV cathode ray tube in accordance with the present invention is capable of being used for small-sized projection TV receivers intended for a viewing screen having a diagonal dimension of a 40-inch class which occupy an intermediate place between direct view TV receivers of 36 inches in maximum screen size and large-sized projection TV receivers of 50 inches in minimum viewing screen size.

The specification and focusing characteristics of the electron gun of the projection TV cathode ray tube for the large-sized projection TV receivers are shown as a case in which the lens-screen distance LP=142.4 mm and the focus electrode length LG4=48.7 mm in FIGS. 2 and 3.

As shown in FIGS. 2 and 3, in the case of the electron gun where the lens-screen distance LP=142.4 mm and the focus electrode length LG4=48.7 mm, the beam spot diameters are 0.168 mm, 0.158 mm and 0.298 mm at the cathode currents of 0.5 mA, 2.0 mA and 6.0 mA, respectively.

The acceptable upper limits of the 5% beam spot diameters for the cathode ray tube for small-sized projection TV receivers in accordance with the present invention are chosen to be 0.193 mm, 0.182 mm and 0.343 mm which are 15% larger than the corresponding values of the acceptable upper limits of the 5% beam spot diameters of the projection TV cathode ray tube for the large-sized projection TV receivers.

The 15% increase in the acceptable upper limits of the 5% beam spot diameters is chosen based upon the fact that the focus characteristics of beam spots on the viewing screen of the projection TV receiver are maintained substantially irrespective of a plus or minus variation of not greater than 15% in the focusing characteristics of beam spots on the phosphor screen of the projection TV cathode ray tube. That is to say, the variations within ±15% in beam spot diameters on the phosphor screen of the projection TV cathode ray tube does not produce much adverse effect on sharpness of images on the viewing screen of the projection TV receiver. The reason is that a projection lens, a reflecting mirror and a viewing screen lens of the projection TV receiver are present between the phosphor screen of the projection TV cathode ray tube and the viewing screen of the projection TV receiver.

As is apparent from FIG. 3, in order to satisfy all the above-described acceptable upper limits of the 5% beam spot diameters for the cathode currents of 0.5 mA, 2.0 mA and 6.0 mA, respectively, when the lens-screen distances LP are selected to be 142.4 mm, 137.4 mm and 132.4 mm, respectively, the focus electrode lengths LG4 need to be selected as follows:

| Lens-Screen Distance LP (mm) LG4 (mm) | Focus Electrode Length |
|---|---|
| 132.4 | 33.2 or longer |
| 137.4 | 35.5 or longer |
| 142.4 | 38.2 or longer. |

It is apparent that beam spot diameters smaller than the above-described acceptable upper limits of the 5% beam spot diameters are obtained by choosing the focus electrode lengths LG4 longer than the lower limits of the focus electrode lengths LG4 shown in the above Table for each of the above lens-screen distances LP.

On the other hand, if the focus electrode length LG4 is increased with the overall length of the projection TV cathode ray tube being fixed, the opening in the phosphor screen 16 side end of the focus electrode (G4) 14 and the anode (G5) 15 forming a main lens with it need to extended toward the phosphor screen 16. However, as is apparent from FIG. 1, if the front end of the anode (G5) 15 disposed excessively close to the deflection yoke 7, a problem arises in that excessive eddy currents are generated in the electrode of the anode (G5) 15 by the deflection magnetic field from the deflection yoke 7 and thereby heat is generated, and this problem cannot be ignored particularly because recently the projection TV receivers have often been operated at a horizontal deflection frequency of two or three times the conventional horizontal deflection frequency of 15.75 Hz.

Further, if the focus electrode length LG4 is increased excessively with the overall length of the projection TV cathode ray tube being fixed, the lens-screen distance LP becomes considerably shorter, and consequently, the center of the main lens is brought excessively close to the deflection yoke 7, and the electric fields of the main lens are distorted by the deflection magnetic field and thereby there is a possibility that the focus characteristics are deteriorated.

Figure 4:
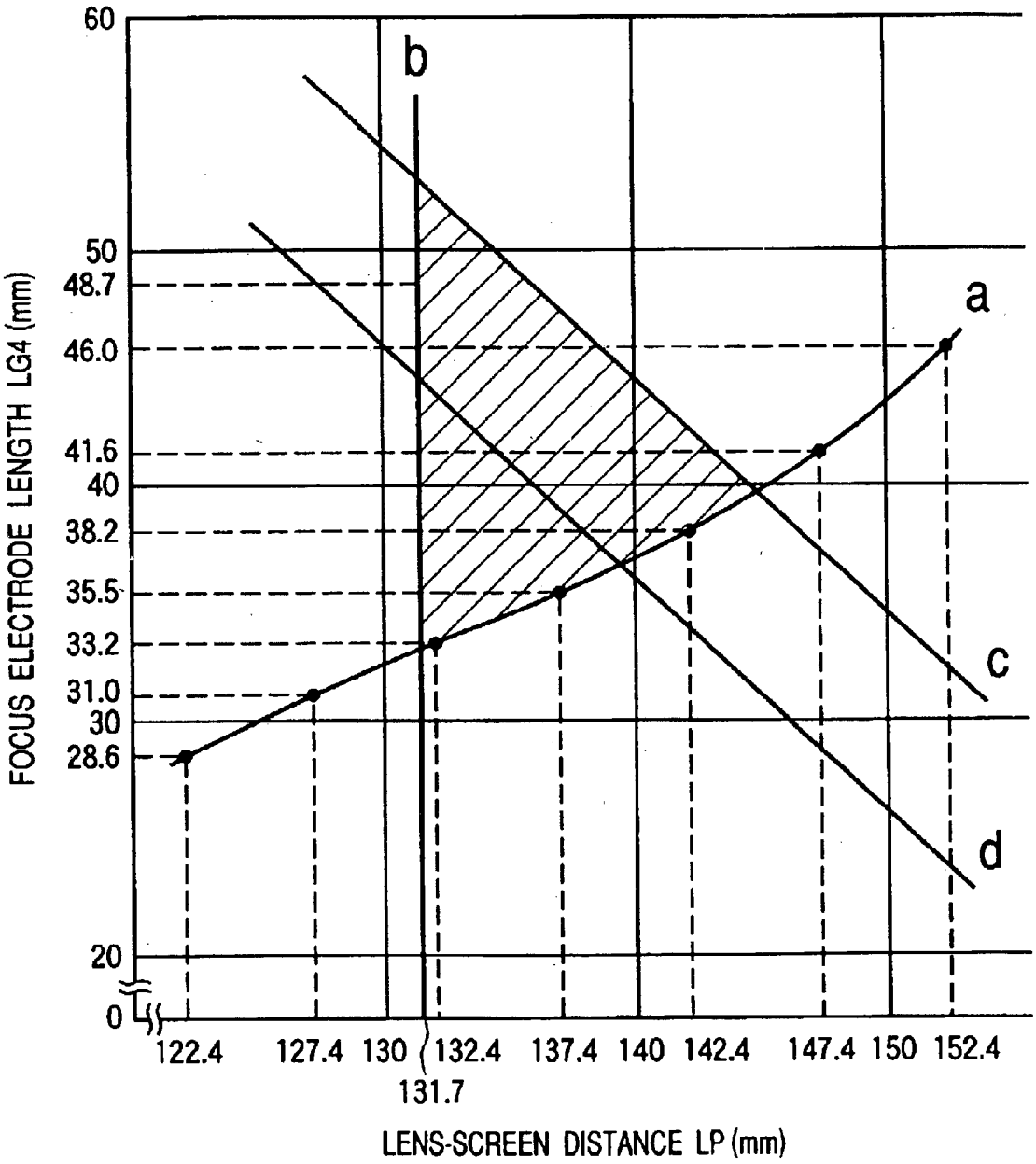
FIG. 4 is a graph showing an allowable range of a relationship between phosphor screen-focus electrode distances LP and focus electrode lengths LG4 in the present invention.
Figure 5:
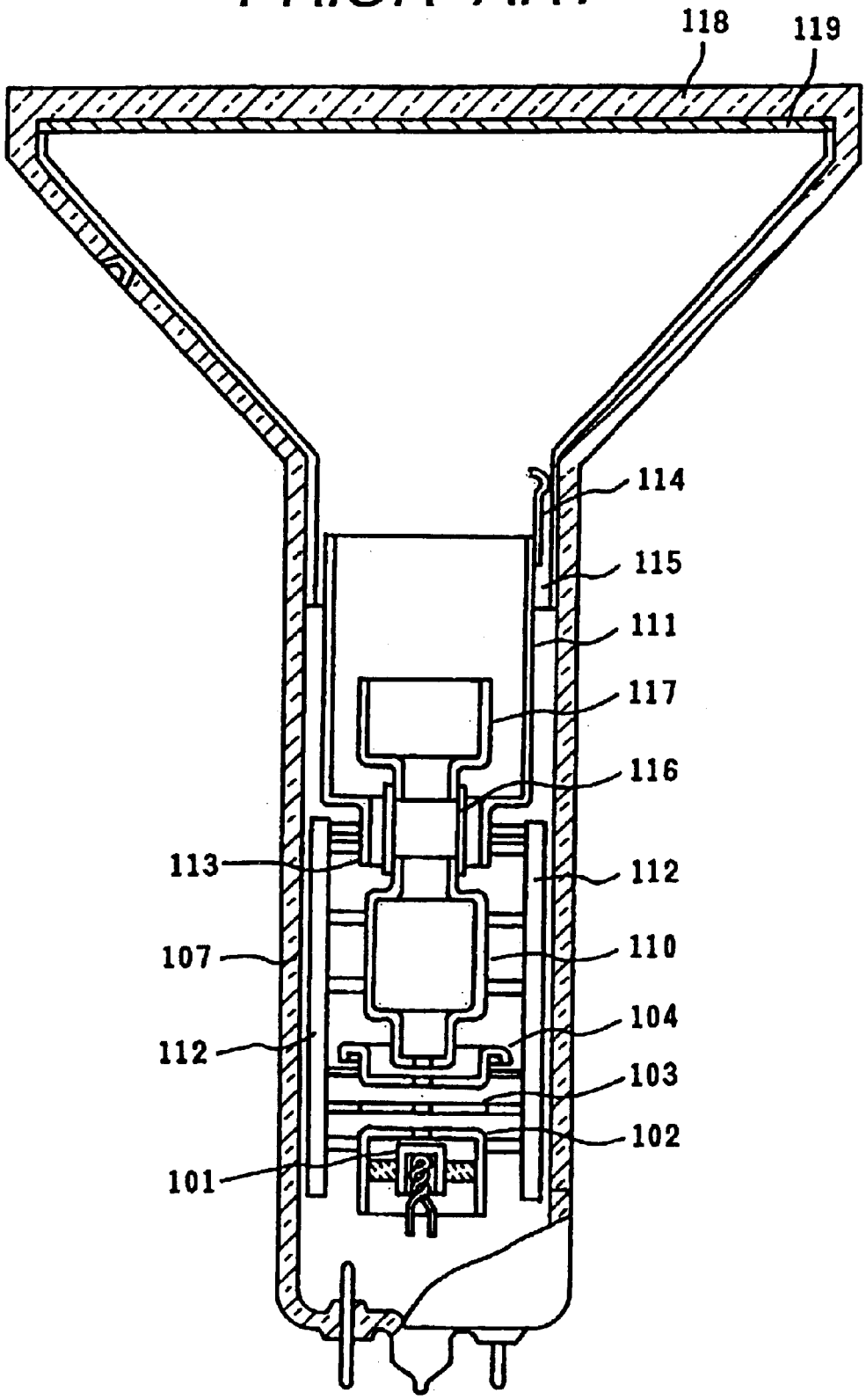
FIG. 5 PRIOR ART
FIG. 5 is a cross-sectional view of a cathode ray tube employing a conventional electron gun.

The present inventors shows the acceptable ranges for the lens-screen distance LP and the focus electrode length LG4 by a hatched area in FIG. 4 based upon the results on the lower limits of the lens-screen distance LP experimentally obtained for prevention of generation of excessive heat due to the eddy currents and deterioration of focus characteristics, the lower limits of the focus electrode length LG4 summarized in the above Table, and the upper limits of the focus electrode length LG4 contributory to shortening of the overall length of the cathode ray tube.

In FIG. 4, curve "a" represents the lower limits of the focus electrode length LG4 (mm), and curve "a" in an embodiment of the present invention is approximated by the following inequality:

$$LG4 \geqq 0.0004\ LP^3 - 0.1571\ LP^2 + 21.006\ LP - 922.41 \quad (1)$$

When the inequality (1) is satisfied, the 5% beam spot diameters are made equal to or smaller than the acceptable upper limits, and consequently the focus characteristics are improved.

Line "b" represents the lower limits of the lens-screen distance LP (mm), and line "b" in the embodiment of the present invention is represented by the following inequality:

$$LP \geqq 131.7 \quad (2)$$

When the inequality (2) is satisfied, the adverse effect of the deflection magnetic field is reduced.

Line "c" represents the upper limits of the focus electrode length LG4 (mm), and line "c" in the embodiment of the present invention is represented by the following inequality:

$$LG4 \leqq -LP + 184.9 \quad (3)$$

When the inequality (3) is satisfied, the projection TV receiver for tabletop use can be realized by shortening the overall length of the cathode ray tube compared with that of the projection TV cathode ray tube for the large-sized projection TV receiver, and thereby suppressing the height and the depth of the projection TV receiver.

Line "d" represents the preferable upper limits of the focus electrode length LG4 (mm), and line "d" in another embodiment of the present invention is represented by the following inequality:

$$LG4 \leqq -LP + 176.1 \quad (4)$$

When the inequality (4) is satisfied, the projection TV cathode ray tube is capable of making its overall length equal to or shorter than 255 mm, and can be used for a more compact small-sized projection TV receiver.

When the relationship between the lens-screen distance LP and the focus electrode length LG4 lies in a hatched area enclosed by curve a, and lines b and c in FIG. 4, the projection TV cathode ray tube satisfies the focus characteristics required of the projection TV cathode ray tube by the projection TV receiver, prevents the problem of heat generation by eddy currents in double-speed (2×15.75 kHz) or triple-speed (3×15.75 kHz) scanning operation, and makes possible miniaturization of the projection TV receiver.

Further, when the relationship between the lens-screen distance LP and the focus electrode length LG4 lies in a hatched area enclosed by curve a, and lines b and d in FIG. 4, the distance from the outer surface of the panel portion of the projection TV cathode ray tube to the outer surface of its stem can be made equal to or shorter than 255 mm.

The present inventors have confirmed the following by various simulations and fabrication of experimental cathode ray tubes in addition to the above-described results of the simulations and the studies:

The present invention produces remarkably beneficial effects on prevention of deterioration of focus characteristics in the case of shortening the overall length of an electron gun when the outside diameter of the neck portion of a projection TV cathode ray tube is chosen to be equal to or smaller than 29.1 mm.

The present invention produces remarkably beneficial effects on ensuring focus characteristics when the effective diagonal dimension of the phosphor screen is selected to be about 139.7 mm and thereby makes a large contribution to miniaturization of the projection TV receiver.

The present invention can make the outside diameter of the neck portion of a cathode ray tube equal to or smaller than 29.1 mm in a case where the inside diameter of the large-diameter cylinder portion of the anode is about 22 mm, the inside diameter of the large-diameter cylinder portion of the focus electrode is about 15.8 mm, and the inside diameter of the small-diameter cylinder portion of the focus electrode is about 9.9 mm, and thereby makes possible realization of a low power-consumption and small-sized projection TV receiver.

The present invention can prevent sufficiently deterioration in focus characteristics by selecting a voltage applied to the focus electrode to be in a range of from 25% to 28% of a voltage to the anode if the overall length of the electron gun is shortened.

The present invention can prevent sufficiently deterioration in focus characteristics by selecting a voltage applied to the anode to be about 30 kV if the overall length of the electron gun is shortened.

The present invention can make the axial length of a "first electrode" to be equal to or smaller than 20.5 mm which is disposed to face a cathode side end of the focus electrode and is supplied with an anode voltage, and thereby makes a large contribution to shortening of the overall length of the cathode ray tube.

As explained above, in representative configurations of the present invention, in a case where the lens-screen distance is shortened for the purpose of shortening the overall length of a cathode ray tube, the length of the focus electrode is optimized such that deterioration in focus characteristics is prevented and also generation of excessive heat due to eddy currents is prevented even in high speed scanning operation, and consequently, the projection TV receiver employing the cathode ray tube of the present invention is capable of realizing its miniaturization and displaying high quality images.

What is claimed is:

1. A cathode ray tube comprising:

a vacuum envelope comprising a panel portion, a neck portion, a funnel portion having a large-diameter end thereof connected to said panel portion and a small-diameter end thereof connected to said neck portion, and a stem having conductive pins embedded therein and closing off an open end of said neck portion on a side thereof opposite from said funnel portion;

a phosphor screen formed on an inner surface of said panel portion;

an electron gun housed within said neck portion; and a deflection yoke mounted externally of said vacuum envelope in a vicinity of a transition region between said neck portion and said funnel portion;

wherein said electron gun comprises a cathode, a beam control electrode, an accelerating electrode, a first electrode, a focus electrode and an anode arranged in the order named with specified spacings therebetween, wherein said anode is formed of a large-diameter cylinder portion disposed on a phosphor screen side thereof and a small-diameter cylinder portion disposed on a cathode side thereof, said large-diameter cylinder portion and said small-diameter cylinder portion being connected together in a direction of an axis of said cathode ray tube, wherein said focus electrode is formed of a large-diameter cylinder portion disposed on a phosphor screen side thereof and having a diameter larger than a diameter of said small-diameter cylinder portion of said anode, and a small-diameter cylinder portion disposed on a cathode side thereof and having a diameter smaller than a diameter of said small-diameter cylinder portion of said anode, said large-diameter cylinder portion and said small-diameter cylinder portion of said focus electrode being connected together in the direction of the axis of said cathode ray tube, said large-diameter cylinder portion of said focus electrode being disposed concentrically with and within said large-diameter cylinder portion of said anode, wherein said anode and said first electrode are electrically connected together within said cathode ray tube, and wherein the following inequalities are satisfied:

$$-LP+184.9 \geqq LG4 \geqq 0.0004\,LP^3-0.1571\,LP^2+21.006\,LP-922.41,$$

where LG4 (mm) is an axial length of said focus electrode, and LP (mm) is a distance from a phosphor screen side end of said focus electrode to a center of said phosphor screen.

2. A cathode ray tube according to claim 1, wherein said LG4 and said LP satisfy the following inequality:

$$-LP+176.1 \geqq LG4.$$

3. A cathode ray tube according to claim 2, wherein a distance from an outer face of said panel portion to an outer face of said stem is equal to or smaller than 255 mm.

4. A cathode ray tube according to claim 1, wherein an outside diameter of said neck portion is equal to or smaller than 29.1 mm.

5. A cathode ray tube according to claim 1, wherein an effective diagonal dimension of said phosphor screen is about 139.7 mm.

6. A cathode ray tube according to claim 1, wherein an inside diameter of said large-diameter cylinder portion of said anode is about 22 mm, an inside diameter of said large-diameter cylinder portion of said focus electrode is about 15.8 mm, and an inside diameter of said small-diameter cylinder portion of said focus electrode is about 9.9 mm.

7. A cathode ray tube according to claim 1, wherein a voltage applied to said focus electrode is in a range of 25% to 28% of a voltage applied to said anode.

8. A cathode ray tube according to claim 1, wherein a voltage applied to said anode is about 30 kV.

9. A cathode ray tube according to claim 1, wherein an axial length of said first electrode is no greater than 20.5 mm.

* * * * *